US006845629B1

(12) United States Patent
Bourne et al.

(10) Patent No.: US 6,845,629 B1
(45) Date of Patent: Jan. 25, 2005

(54) VERTICAL COUNTERFLOW EVAPORATIVE COOLER

(75) Inventors: Richard C. Bourne, Davis, CA (US); Brian Eric Lee, Monterey, CA (US); Duncan Callaway, Oakland, CA (US)

(73) Assignee: Davis Energy Group, Inc., Davis, CA (US)

( * ) Notice: Subject to any disclaimer, the term of this patent is extended or adjusted under 35 U.S.C. 154(b) by 3 days.

(21) Appl. No.: 10/624,633

(22) Filed: Jul. 23, 2003

(51) Int. Cl.[7] ..... F28D 5/00
(52) U.S. Cl. ..... 62/304; 62/434; 165/166
(58) Field of Search ..... 62/304, 306, 308, 62/434; 165/164, 166

(56) References Cited

U.S. PATENT DOCUMENTS 3,808,104 A * 4/1974 Davidson ..... 202/173
4,216,820 A * 8/1980 Andrew ..... 165/115
4,411,310 A * 10/1983 Perry et al. ..... 165/166

* cited by examiner

*Primary Examiner*—Melvin Jones
(74) *Attorney, Agent, or Firm*—Oliff & Berridge, PLC

(57) ABSTRACT

An evaporative heat exchanger having parallel plates that define alternating dry and wet passages. A water reservoir is located below the plates and is connected to a water distribution system. Water from the water distribution system flows through the wet passages and wets the surfaces of the plates that form the wet passages. Air flows through the dry passages, mixes with air below the plates, and flows into the wet passages before exiting through the top of the wet passages.

34 Claims, 5 Drawing Sheets

VERTICAL COUNTERFLOW EVAPORATIVE COOLER

This invention was made with Government support under Contract #DE-FC26-00NT40991 awarded by the United States Department of Energy. The Government has certain rights in the invention.

BACKGROUND OF THE INVENTION

1. Field of Invention

This invention relates to evaporative cooling units, and particularly to "multi-stage" units designed primarily to cool water, or both water and air, to temperatures lower than can be achieved in simple "direct evaporative" cooling devices.

2. Description of Related Art

Simple evaporative coolers benefit from the psychrometric process in which dry air and water can be cooled by adding moisture. At their performance limit, these coolers can cool both air and water to the outdoor wet bulb temperature. Multi-stage evaporative coolers use an indirect evaporative process to cool some of the air without adding moisture. This indirect process also lowers the wet bulb temperature of the indirectly-cooled air, making it possible in a second, direct cooling stage, to cool both air and water to a lower temperature than the wet bulb temperature of the original dry air. Additional indirect stages after the first can continue lowering the wet bulb temperature to achieve cooler and cooler "product" (air or water); the theoretical limit is the dew point temperature of the outdoor air. However, it is not practical to achieve this limit for cooling air because a great deal of "parasitic" energy would be consumed forcing air through the multiple indirect stages.

In the prior art, multi-stage evaporative cooling processes have primarily been applied to cooling air in applications where the lower outlet air temperatures (compared with a direct evaporative process) allow two-stage evaporative cooling to be substituted for a vapor-compression mechanical cooling process. One such example is the "Regenerative Evaporative Cooler" described in U.S. Pat. No. 6,338,258. This design uses alternating wet and dry heat exchange passages to cool a dry air stream, with a portion of the cooled air then supplying the wet "secondary" passages that indirectly cool the dry passages. The dry air stream can be further evaporatively cooled in a direct stage to complete the process before being delivered into a building as supply air. U.S. Pat. No. 5,301,518 describes another indirect stage that uses a portion of the indirectly cooled airstream as secondary air for the wet passages. This design features a low profile plate system that eliminates the circulation pump by wicking water from the sump to the wet plate surface. Both of these designs are intended solely to cool air in the indirect stage.

Two stage systems are seldom used to cool water. Many one-stage evaporative cooling systems called "cooling towers" are used to cool condenser water in large cooling systems. Cooling towers use fans to draw outdoor air through a distributed falling water pattern, such that the air is humidified as it cools the warm water leaving the chiller condenser. Cooler water entering the condenser increases chiller efficiency, and increasing the cooling tower size is often a cost-effective strategy for lowering the water temperature. But, simple cooling towers cannot cool water to below the outdoor air wet bulb temperature, as two stage units can. In the future, if energy costs continue to rise as expected, two stage cooling towers might achieve favorable paybacks.

A major untapped opportunity for commercial building systems is evaporative pre-cooling of ventilation air. At least 10% of supply air in many such buildings is typically outdoor air needed for building ventilation. In some cases, particularly for laboratory facilities, cooling systems must deliver 100% outdoor air. In warm weather, cooling of ventilation air represents a significant fraction of the total cooling load. In very dry climates, ventilation air can be pre-cooled by a direct evaporative process, but in most applications an indirect process that adds no moisture to the ventilation air is preferred. A plate-type indirect heat exchanger used as a booster stage for a cooling tower could also be used to pre-cool ventilation air.

Another ventilation air cooling opportunity is for "dedicated outdoor air" units that detach the ventilation air load from other HVAC components. These dedicated units are receiving increasing attention as an option to "variable-air-volume" (VAV) systems that have difficulty maintaining required fresh air volumes at low speeds. A plate-type heat exchanger delivering 100% outdoor air, with building exhaust air used in alternating wet passages, can be used as an indirect evaporative ventilation air cooling unit in the cooling season and, without water feed to the exhaust air passages, as a heat recovery unit in the heating season. Most current forced air heating systems fail to take advantage of the opportunity to apply heat exchangers for pre-heating ventilation air from warm building exhaust air.

Most new low-rise non-residential buildings in the U.S. are cooled by packaged rooftop units ("RTU's") that include one or more compressors, a condenser section that includes one or more air-cooled condensing coils and condenser fans, an evaporator coil, a supply blower, an intake location for outdoor ventilation air (with or without an "economizer" to fully cool from outdoor air when possible), optional exhaust air components, and controls. These components are packaged by manufacturers in similar configurations that, because they are air-cooled, fail to take advantage of the opportunity to improve efficiency and reduce electrical demand through evaporative cooling of both condenser and ventilation air streams. This opportunity is particularly significant in dry climate locations where rapid growth and focus on low construction costs have caused a high percentage of non-residential cooling systems to use RTU's rather than more efficient systems that use chillers and cooling towers.

There is also an opportunity for energy-efficient systems that can deliver "naturally-cooled" water for circulation through tubing in concrete slabs to pre-cool the building structure. The tubing can function reversibly to deliver comfortable radiant floor heating in winter.

For these and other reasons, there is a need for improved cooling units that incorporate plate-type evaporative heat exchangers that efficiently cool either water or air, or both, to temperatures lower than can be achieved in conventional evaporative coolers.

SUMMARY OF THE INVENTION

The present invention is directed to an improved counterflow plate-type evaporative heat exchanger that can effectively cool either air, or water, or both, to temperatures lower than can be achieved in conventional evaporative coolers. The invention is designed principally for use in systems that provide heating, ventilation, and air conditioning (HVAC) to buildings that satisfy the needs stated above. An exemplary embodiment of the invention comprises: an evaporative section that includes a plate-type evaporative cooler that cools both water and air; a water sump, pump, and water distribution system that captures and re-circulates water within the evaporative section; automatic systems that refill and drain the water sump; a fan that exhausts air from the evaporative section; electrical controls; and a cabinet that houses the unit. In alternate preferred embodiments, the cabinet and sump are configured to allow the counterflow heat exchanger to pre-cool building ventilation air, and to recover heat from a building exhaust air stream.

In an exemplary embodiment of the invention, each evaporative section consists of a novel plate-type evaporative heat exchanger with alternating dry and wet passages, edge sealing features that prevent water from a water distribution system above the heat exchanger from entering the dry passages, openings that allow outdoor air to enter the top sides of the dry passages, and inlet screens or filters that prevent bugs and debris from entering the system. In an exemplary embodiment designed just to cool water, outdoor air pulled downward through the dry passages emerges into the sump, is then drawn upward through the wet passages by the top-mounted fan, which exhausts the airstream back to the outdoors.

In alternate exemplary embodiments designed to cool both water and air, the dry passages also have lower side openings through which a portion of the dry passage air may be drawn, as pre-cooled ventilation air, into the building's supply air system or directly into the building. In these embodiments, a volume of building exhaust air equal to the ventilation air quantity enters the sump to be exhausted through the wet passages. In one alternate exemplary embodiment a portion of the dry passage air will be drawn off and replaced with exhaust air, and the remainder of the dry passage air will flow around the bottom plate edge and into the wet passages. In a second exemplary embodiment, the bottom edges of the dry passages are closed and all dry passage air exits through the bottom side openings. In this embodiment, all wet passage air is building exhaust air. For both alternate embodiments, the parallel plate heat exchanger may be used, with the pump not operating, as an air-to-air heat exchanger that recovers heat from building exhaust air in the heating season.

These and other features and advantages of this invention are described in or are apparent from the following detailed description of various exemplary embodiments of the systems and methods according to the invention.

BRIEF DESCRIPTION OF THE DRAWINGS

The invention will be described in detail in reference to the following drawings in which like reference numerals refer to like elements and where.

DETAILED DESCRIPTION OF PREFERRED EMBODIMENTS

Figure 1:
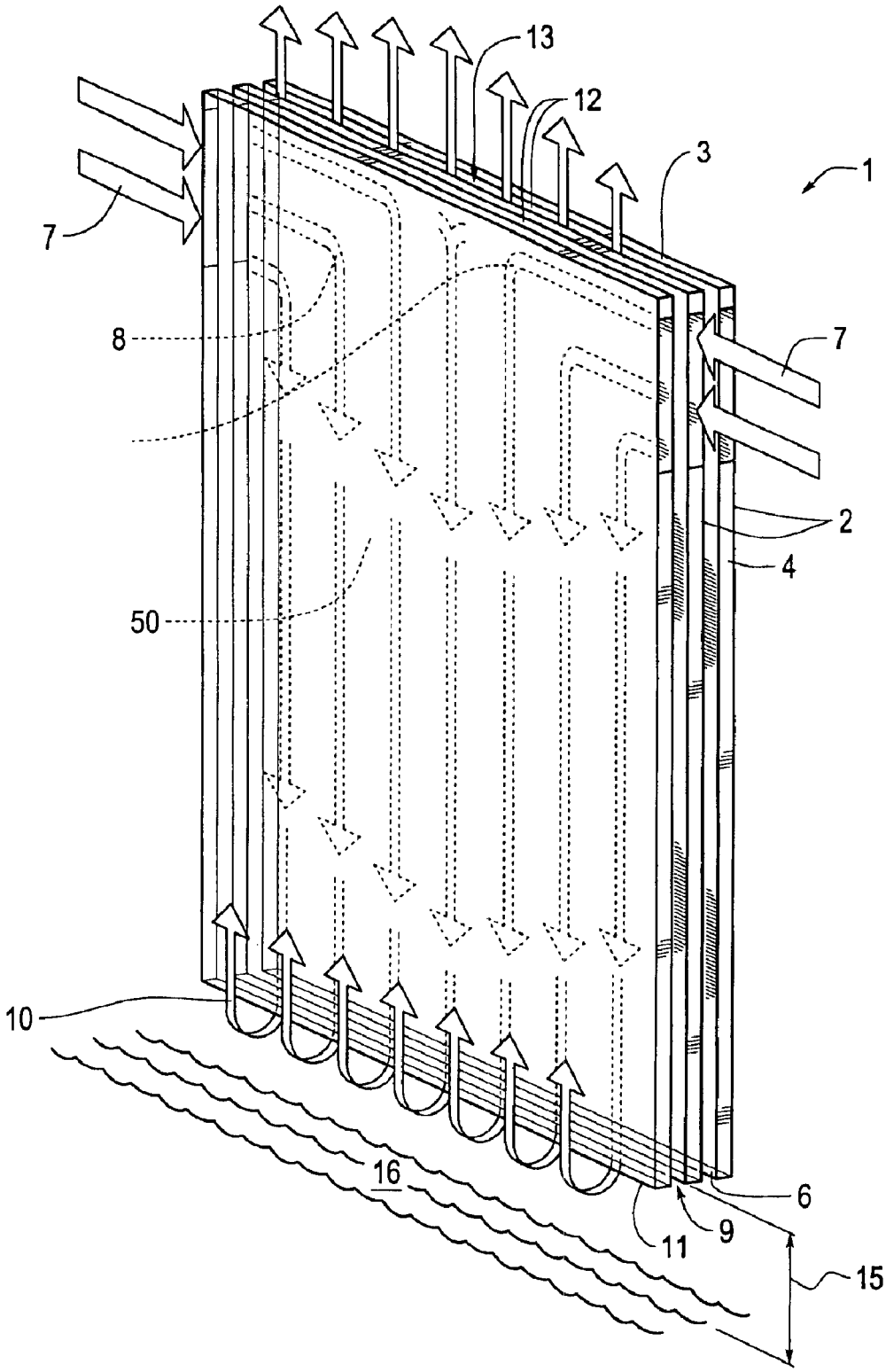
FIG. 1 is a perspective view showing airflow patterns in the parallel heat exchange plates of the present invention, in which an exemplary embodiment is designed to cool water, and all dry passage air becomes wet passage air.

Various exemplary embodiments of the present invention are described hereafter with reference to FIG. 1–5. FIG. 1 shows a perspective view showing airflow patterns in the parallel heat exchange plates of the present invention, in which an exemplary embodiment is designed to cool water, and all dry passage air becomes wet passage air. While FIG. 1 shows symmetrical airflows with air entering at both sides and, with reference to FIGS. 2 and 3, leaving at both bottom sides, tall narrow plates may perform well with air entering and leaving on just one side because larger and more vertical heat exchange plates generally offer better performance if the spacing between plates is adequate.

FIG. 1 is a perspective view showing an airflow pattern in the parallel heat exchange plates of a first embodiment of the present invention. In the first exemplary embodiment, designed just to cool water, all air entering the top side dry passage inlets flows around the bottom plate edges, enters the wet passages, and flows upward to exit through the open wet passage top edges. Both water and air are cooled as they move downward toward the reservoir. The design of this exemplary embodiment offers superior performance as a high performance "cooling tower," since with adequate height and air flow rate, the theoretical lower limit temperature for both air and water is the dew point temperature of the outdoor air. This superior performance is possible because air entering the wet passages has been cooled without moisture addition, lowering its wet bulb temperature. By comparison, the theoretical lower limit for a conventional cooling tower is the wet bulb temperature of the outdoor air.

Since the evaporative heat exchanger in this embodiment is designed to cool water, the implicit assumption is that water pumped from the reservoir first circulates through a heat source designed to discharge heat to the water, before entering the water distribution system located above the heat exchange plates of the present invention. This heat addition may come from either a chiller/condenser, a process cooling load, or directly from a building due to air circulation through either a fan coil, a "radiant surface" cooling system, or a natural convection heat exchanger.

Referring to FIG. 1, heat exchanger plate assembly 1 consists of multiple plate pairs 2 aligned in a parallel vertical configuration. Each plate pair 2 may be formed from a single sheet folded at the horizontal top edge 3, and with closed vertical side edges 4 except for upper side openings 5 and full horizontal bottom edge opening 6 between bottom plate edges 11. Alternatively, manufacturing constraints may require that each plate pair comprises two opposed plates that are fused or otherwise joined to prevent air and water leakage along their adjoining top edges. Thus, each plate pair 2 encloses a dry passage 50 between its parallel sides, and allows the first airstreams 7 to flow inward through the upper side openings 5 into the dry passages 50. The airstreams 7 make a 90 degree turn at a turn portion 8 in the top area of the dry passage 50 inside the plate pair 2, and then flow downward to the plate edges 11.

In the first exemplary embodiment, the first airstreams 7 flow outward through the bottom opening 6. The airstreams 7 turn 180 degrees upward after exiting the dry passages 50 to enter the wet passage bottom openings 9 and become second air streams 10. In this exemplary embodiment, a vertical gap 15 between the plate bottom edges 111 and the water 16 in the reservoir 20 can be as small as twice the average spacing between plates (typically ¼" to ½"), since no air stream enters through the reservoir 20. The second air streams 10 then flows upward in the wet passages 12 and outward at the wet passage top openings 13 defined between the adjacent plate pairs 2. A single air mover (not shown) may be used to cause the flow of both the first air streams 7 and the second air streams 10, since they become the same air stream when completing the 180 degree turn around the bottom plate edges 11. A top-mounted propeller-type air mover (see FIG. 4) located above the plate assembly 1 may be used to simplify the flow configuration and avoid adding motor heat to the cooling air stream.

Figure 2:
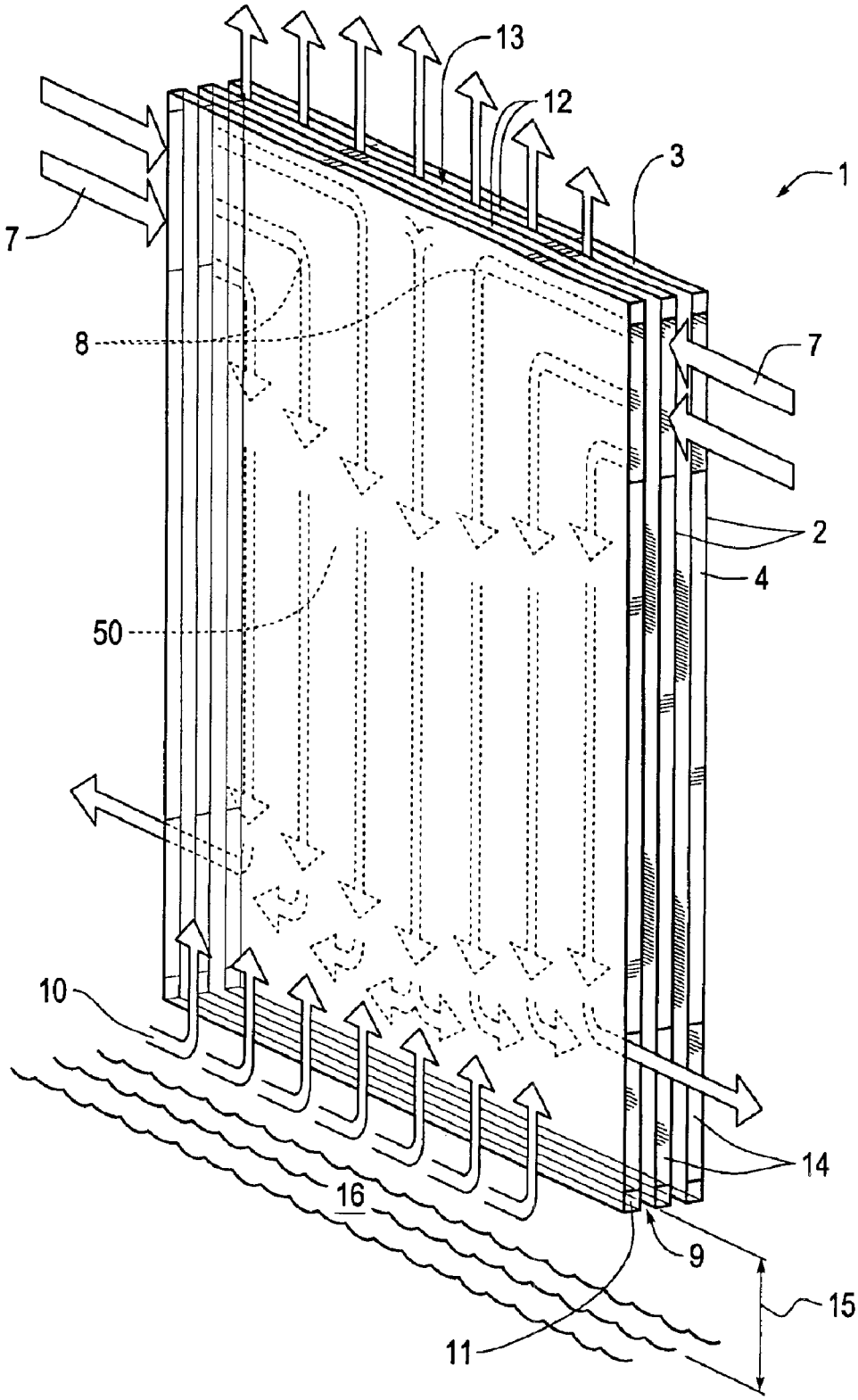
FIG. 2 is a perspective view showing airflow patterns in the parallel heat exchange plates of the present invention, in which an exemplary embodiment is designed to cool both water and air, and all dry passage air is removed to become ventilation air or cooled process air, with all wet passage air entering between the reservoir and the underside of the heat exchanger plates.

FIG. 2 is a perspective view showing airflow patterns in the parallel heat exchange plates of the present invention, in which a second exemplary embodiment is designed to cool both water and air, and all dry passage air is removed to become ventilation air or cooled process air, with all wet passage air entering between the reservoir and the underside of the heat exchanger plates.

In the second exemplary embodiment of the present invention, designed to cool both water and air, all cooled air in the dry passages 50 is removed to become ventilation air or cooled process air, and is fully replaced by relatively cool dry air (typically building exhaust air) that enters through the gap 15 between the reservoir and the underside of the heat exchanger plates 2. In this embodiment, the adjacent plate bottom edges 11 are sealed to each other to close the dry passages 50 at the bottom. All dry passage air exits through the dry passage lower side outlets 14. Second air stream 10 enters the reservoir area 20 from outside the heat exchanger cabinet 40 (FIG. 4), and requires a larger gap 15 between the plate bottom edges 11 and water 16 in the reservoir, so that the second air stream 10 may flow uniformly into the wet passage bottom openings 9.

Figure 3:
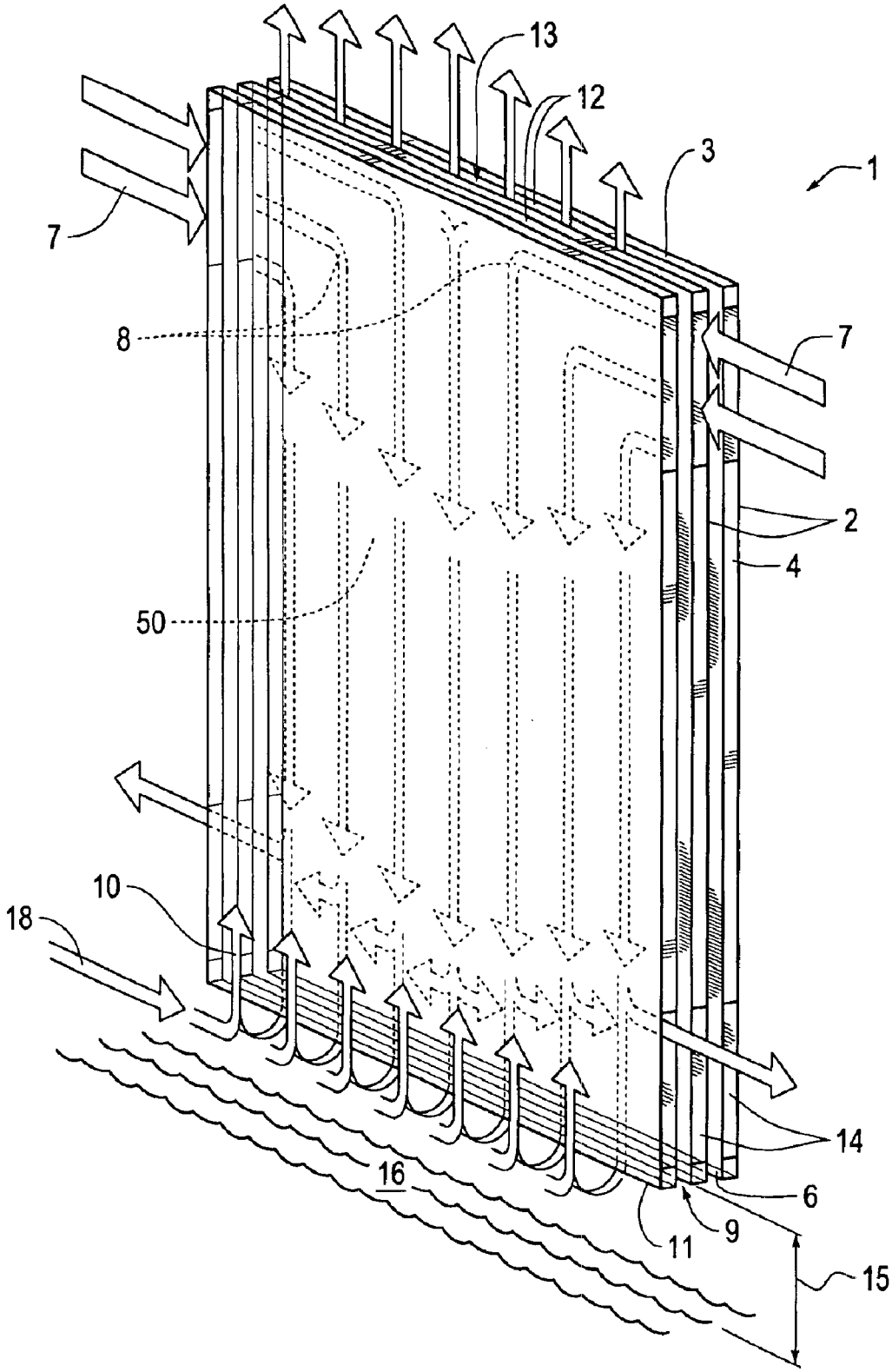
FIG. 3 is a perspective view showing airflow patterns in the parallel heat exchange plates of the present invention, in which an exemplary embodiment is designed to cool both water and air, with a portion of the dry passage air removed and replaced by air entering between the reservoir and the underside of the heat exchanger plates, and the remainder of the dry passage air becoming wet passage air.

FIG. 3 is a perspective view showing airflow patterns in the parallel heat exchange plates of the present invention, in which a third exemplary embodiment is designed to cool both water and air, with a portion of the dry passage air removed and replaced by air entering between the reservoir and the underside of the heat exchanger plates, and the remainder of the dry passage air becoming wet passage air.

The third exemplary embodiment, also designed to cool both water and air, is similar to the second exemplary embodiment except that the bottom openings 6 are present as well as the dry passage lower side outlets 14. This embodiment allows a portion of the first air steam 7 to be drawn off as pre-cooled ventilation or process cooling air, with the remainder turning in the reservoir area 20 to become part of the wet passage air stream. This embodiment may have smaller lower side outlets 14, and requires less vertical gap 15 between the plate bottom edges 11 and the water 16 in the reservoir 20, than in the second exemplary embodiment since only a portion of the second air stream 10 must enter through the gap 15.

For cooling of buildings, the second exemplary embodiment is designed for "100% outdoor air" applications, while the third exemplary embodiment is designed for the more common situation where the required ventilation air flow rate is smaller than the plate heat exchanger flow rate required for effective evaporative cooling of either the vapor-compression system condenser or a direct building cooling heat exchangers.

Figure 4:
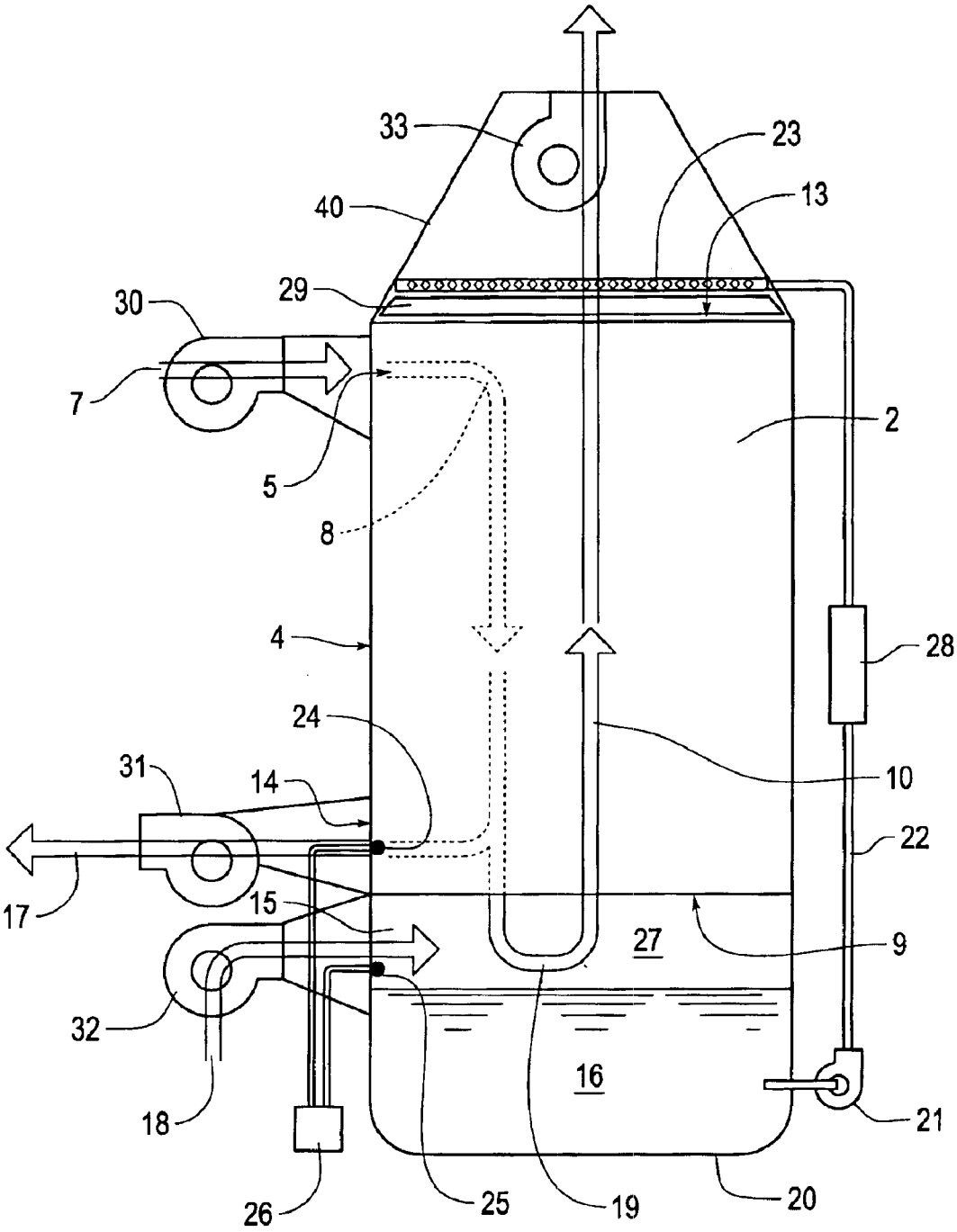
FIG. 4 is a schematic cross-sectional view of the vertical counterflow evaporative cooler showing the water circuit and the range of air circulation strategies that may be used for the three described exemplary embodiments.

FIG. 4 is a schematic cross-sectional view of the vertical counterflow evaporative cooler showing the water circuit and the range of air circulation strategies that may be used for the three described embodiments. FIG. 4 shows a plate pair 2, enclosed by a cabinet 40 and placed above water reservoir 20, which is filled with water 16. When operating, a pump 21 delivers water from the reservoir 16 upward through a discharge pipe 22 to a water distributor 23 above the heat exchange plates 2. The distributor 23 uniformly wets the top openings 13 of the wet passages 12. Water then flows downward through wet passages 12, in which it is partially evaporated and cooled by the second airstream 10 flowing upward through wet passages 12. Not shown are water refill and purge or bleed features needed for all evaporative cooling units.

FIG. 4 also shows schematically two component alternatives for heat rejection from a building cooling system. One of these components will always be present for the first exemplary embodiment , in which the vertical counterflow evaporative cooler is used solely to cool water. One or the other will also be present for those second and third exemplary embodiment applications that pre-cool ventilation air while also rejecting heat from a condenser or direct hydronic building cooling system. A closed heat exchanger 28 in the discharge pipe 22 from the pump 21 represents several alternatives for delivering heat from a building to the evaporative cooler, including:

a) a condenser for a refrigerant-based cooling system, in which hot refrigerant gas is condensed while heating water pumped through the pipe 22;

b) "radiant tubing" embedded in a floor or other building interior surface;

c) a "fan coil" that discharges heat from forced warm room air to cooler reservoir water d) a "free convection" heat exchanger such as a hydronic baseboard or valence that causes room air to naturally flow across its fins and tubing by virtue of the cooler-than-air water flowing through its tubing.

An alternate "open" heat exchanger 29 represents a tubing array located beneath the water distributor 23 instead of, or in addition to, the closed heat exchanger 28. Any of the above four cooling devices may be connected to the heat exchanger 29. One advantage of this open heal exchanger 29 is that it may be more easily cleaned than a closed heat exchanger. However, for hydronic configurations b), c), and d), a second pump is necessary; pump 21 cannot be used to circulate reservoir water through the radiant tubing, fan coil, or convector.

While FIG. 1 shows a symmetrical air flow configuration in which first airstreams 7 flow into upper side openings 5 into the dry passages 50 on both sides, for simplicity, FIG. 4 shows a narrower profile in which upper side openings 5 are located only on one side of the plate pair 2. FIG. 4 shows four possible air mover locations 30, 31, 32, and 33, though typically no more than two air movers will be used with a particular embodiment.

In the first exemplary embodiment, shown in FIG. 1, the bottom dry passage openings 14 are not present and all of the dry passage air turns the corner to become all of the wet passage air. In this embodiment, either air mover 30 or 33, or both, may be used to move dry passage first airstream 7 inward through upper side openings 5, through 90 degree turn at the turn portion 8, downward through the dry passages 50, out the dry passage bottom openings 6, and into the wet passage bottom openings 9 where the air becomes wet passage second airstream 10, finally flowing upward through the wet passage top openings 13 from which the second airstream 10 is discharged.

In general, the preferred air mover selection for the first exemplary embodiment is a propeller-type fan 33 that pulls air through the extended air path. This approach uses a relatively low-cost air mover and places the fan motor in the discharge air path where the motor heat has no negative impact on performance.

For the second exemplary embodiment, shown in FIG. 2, in which all dry passage air is typically drawn away as pre-cooled ventilation air and all wet passage air is typically building exhaust air, more air mover combinations are viable because the two airstreams are fully separated. For example, in this embodiment two air movers will typically be used to insure proper flow rates for both airstreams 7 and 10. With reference to FIG. 4, all of the dry first airstream 7 flows out through the outlet 14 to become pre-cooled airstream 17. The airflow path 19 is closed, and the bottom openings 6 are not present. The dry first airstream 7 may be propelled either by an inlet blower 30 or an exit blower 31. For cost reasons, air mover placement in both locations is unlikely. The choice between inlet and outlet locations for the dry airstream air mover will typically be determined based on convenience of service access. From the performance standpoint, the location of inlet blower 30 is preferred because a portion of the motor heat will be discharged in the plate heat exchanger.

For the wet passage air mover, the preferred selection for the second exemplary embodiment is also a propeller-type fan 33. In this embodiment, the exchanger may be operated in a winter heat recovery mode with the water pump 21 not operating. In this mode outdoor air used for ventilation is preheated as it proceeds downward through the dry passages 50 by convective/conductive heat transfer contact across the plate walls with the building exhaust air stream moving upward.

For the third exemplary embodiment, shown in FIG. 3, a portion of the dry passage air is drawn off and the remainder of the air enters the wet passages; and building exhaust air, roughly equal in volume to the dry portion drawn off, also enters the wet passages 12. In this embodiment, all air passages shown in FIG. 4 are used, and the air movement strategy must control pressures to prevent air above the reservoir 20 from mixing with ventilation air drawn off through the bottom openings 14. As with the second exemplary embodiment, the third exemplary embodiment may be operated as an accessory to another air mover. For example, the vertical counterflow evaporative cooler of the third exemplary embodiment may be used as a combined ventilation air pre-cooler and evaporative condenser for a packaged rooftop cooling unit. In such applications, the dry passage first airstream 7 could be propelled by a supply blower 31, with building exhaust airstream 18 forced through the opening 15 by an exhaust air blower 32. However, a top-mounted air mover 33 must also be used to assure that some of dry first airstream 7 follows through the airflow path 19, out the dry passage bottom openings 6, and into the wet passage bottom openings 9.

The most economical configurations of the third exemplary embodiment will have only two air movers, one for each airflow path. In this embodiment, the dry first airstream 7 is typically used for ventilation air for a building. Since the reservoir 20 contains water 16 that could harbor biological growth, air in space 27 above the water 16 should not be allowed to mix with air leaving the dry passages at outlets 14. Therefore air mover location and operation must be selected and controlled to assure that pressure at the opening 15 is always lower than pressure at the outlet 14 thereby preventing airflow upward along airflow path 19. Maintaining this desired pressure pattern under fixed airflow conditions favors use of a top-mounted exhaust air mover 33 and an inlet dry passage air mover 30. For a "stand-alone" ventilation unit, air mover types and motors may then be selected that always maintain the desired flow rates and pressure pattern.

However, in cases where the vertical counterflow evaporative cooler is an attached accessory or integral component in a rooftop HVAC unit, supply and or exhaust air movers may be present that will affect the pressure patterns at outlet 14 and opening 15. In effect these air movers can be represented by air movers 31 and 32 in FIG. 4. On larger HVAC units, these air movers will operate at variable speeds in response to cooling and heating loads of the building. It is therefore desirable to operate air movers 30 and 33 at variable speeds in response to pressure sensors such that the pressure at outlet 14 is always greater than the pressure at inlet 15. FIG. 4 shows air pressure sensors 24 at outlet 14 and pressure sensor 25 at inlet 15, connected to a controller 26. In response to signals indicating that the positive pressure differential between the sensors 24 and 25 is falling to a threshold value, the controller 26 can either command air mover 30 to speed up or air mover 33 to slow down or stop to maintain the desired minimum pressure differential.

There are additional reasons to use a variable speed air mover 30 or 31 for the dry passage first airstream 7. In many cases the building ventilation air flow rates for the second and third embodiments are prescribed by building codes and must be maintained at or above a minimum level for all hours in which the building is occupied. To minimize blower energy use, supply blowers are often equipped with variable speed controls that lower air flow rates when cooling and heating loads are low. When the present invention provides ventilation air for these systems, the ventilation rate will vary with the flow rate for the main blower (not shown). In these conditions a variable speed air mover 30 or 31 and associated controls are needed to maintain a constant ventilation air flow rate through ventilation air outlet 14.

In other applications of the second and third exemplary embodiments, the minimum ventilation rate may be varied in response to a carbon dioxide ($CO_2$) sensor in an occupied space (not shown) that assesses whether enough fresh air is being delivered. In these situations, a variable speed air mover 30 or 31 may be used as needed in response to the $CO_2$ sensor, while exhaust air mover 33 maintains the desired flow rate through the wet passages 12.

Figure 5:
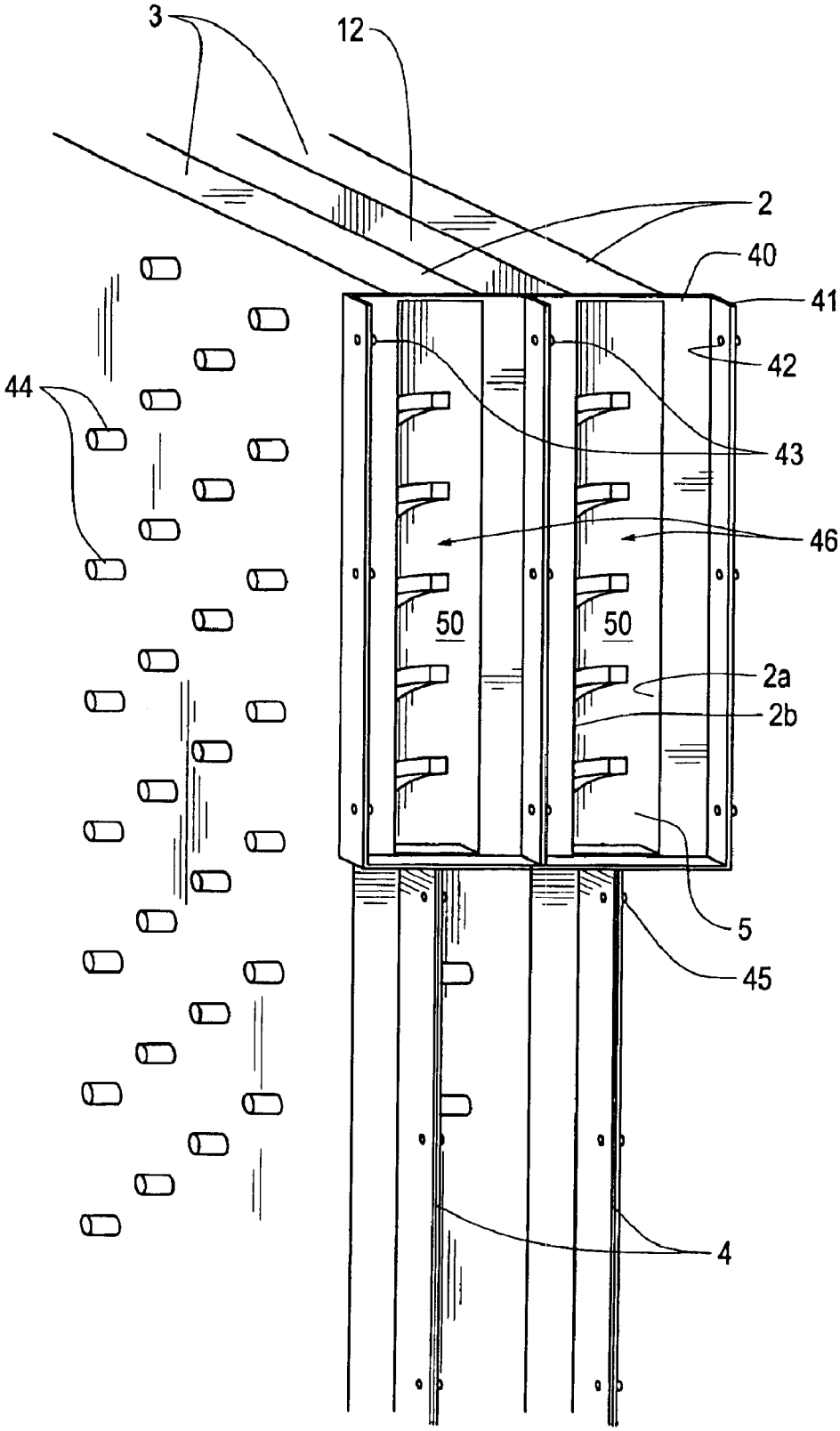
FIG. 5 is a cut perspective view showing details of plate construction.

FIG. 5 is a cut perspective view showing top corner details of the heat exchange plate construction for an exemplary embodiment of the present invention using thermoformed plastic plates. While thermoformed plastic plates are shown, the plates can be made of other materials, as will subsequently be discussed. Plate performance characteristics include:

1) maintaining moisture separation between the dry and wet passages;
2) facilitating uniform wetting of the wet passage surfaces;
3) creating and maintaining uniform air flow gaps in both dry and wet passages;
4) facilitating assembly of plate pairs into a multiple plate "bundle"; and
5) increasing lifetime without breakage, corrosion or other degradation.

The formability of plastic sheet material makes it ideal for fabrication of the necessary heat exchange plates. FIG. 5 shows several key advantages of thermoformed sheets for the folded heat exchanger plate application. This partial isometric view shows two adjacent plate pairs and several key features that minimize assembly labor.

With reference to FIG. 5, plate pairs 2 comprise plate sides 2*a* and 2*b* in parallel arrangement after being folded 180 degrees from relatively flat sheets about top folds 3. Along the top side of folded plate pair 2 is air inlet opening 5, while the middle side edge is closed. In the first exemplary embodiment, the lower edge 6 is also closed. In the second and third exemplary embodiments, the lower edge 6 is open for ventilation air exit 14 (not shown). The vertical plate edges include top edge features 40, 41, and 42 that facilitate interconnection of the plate pairs, and lower edge features (not shown) that facilitate connection of sides 2*a* and 2*b*, to close dry passages 50 below air inlet openings 5. Each edge extension 40 perpendicular to fold 3 covers half the wet passage width between plate pairs 2, and edge flaps 41 from extension 40 provide aligning surfaces to support engaging snaps 42 and 43 that secure adjacent plate pairs to each other. Receiving formed recess 43 on mating edge flap 41 can be a cube pattern whose width and height are slightly smaller than the diameter of insertable cylindrical extension 42 on the mating edge flap 41 of the adjacent plate pair. These "snaps" can be located intermittently along both edges and the bottom of the assembly of plate pairs. Similar snap features 45 are used below the dry passage openings 5 to interlock the lower edges of sides 2*a* and 2*b* for each plate pair 2, and (not shown) along the open bottom edges of the first and third exemplary embodiments, and along the closed dry passage bottom edge in the second exemplary embodiment.

Two other types of thermoformed features are used in the present invention to eliminate other parts. First, a pattern of protrusions 44 maintains proper spacing in the wet passages 12. Since air pressure in the dry passages 50 is always higher than the air pressure in the wet passages 12, protrusions 44 are necessary to prevent the differential air pressure from deforming the plastic plate walls and closing or severely restricting the wet passages 12. The protrusions 44 are typically either cylindrical or vertically elongated since air always flows vertically in the wet passages. The protrusions 44 extend "wall-to-wall" across each wet passage, with approximately half their pattern projecting from each of the opposed plate walls. This strategy avoids the need for precise location as would be necessary for mating spacers to meet halfway across the wet passage gap.

The second type of thermoformed feature is used to assist air that enters the dry passage openings 5 to transition from horizontal to downward vertical flow. These "turning vanes" 46 are elongated, curved protrusions into the dry passages that turn the entering air. The vanes are strategically located based on air flow tests to cause uniform downward air velocities out the bottom edge openings 6 of dry passages 50. Relatively uniform velocities in both dry and wet air passages result in the most effective overall heat transfer. Imbalanced flows that "starve" a part of the heat transfer plate area result in reduced overall heat transfer. Vanes 46 are most necessary when the dry passage air mover forces air into the openings 5, when without the vanes 46 the entry side of the dry passage might experience reduced flow due to the horizontal inertia of the entering air.

One disadvantage of plastic heat exchange plates for use in the present invention is that they may need special surface treatments to promote the uniform wetting that maximizes indirect evaporative cooling performance. However, several techniques are available to overcome this disadvantage, including texturing the thermoforming mold, and sanding or etching the flat surfaces of the formed plates.

While thermoformed plates are preferred, an alternate, more labor-intensive strategy for fabricating the plate pairs, and heat exchangers assembled from multiple plate pairs, may also be used. This strategy uses a flexible paper/plastic laminated sheet material (not shown). Each "plate pair" uses a top-folded sheet with its plastic layer facing the interior (dry) passage. The outer, treated paper surface gives the sheet most of its strength. This surface wets well and, as the wet passage lining, maximizes evaporative performance. But plate spacings and attachments typically require additional components, features, and assembly labor. For example, strip or point spacers must be placed in the wet passages, and perforated strips or individual turning vanes must be adhered in the dry passages to balance air flow when the air is forced into (rather than drawn through) the dry passages.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, other combinations and configurations, including more, less, or only a single element, are also within the spirit and scope of the invention.

What is claimed is:

1. A counterflow plate-type evaporative heat exchanger, comprising:

a plurality of parallel plates having side edges and top and bottom edges, wherein said parallel plate pairs define alternating dry and wet passages;

a water reservoir disposed below said plates connected to a water distribution system disposed above said plates, and a pump that circulates water from said reservoir to said distribution system, and wherein said water flows downward through said wet passages, to wet the surfaces of the plates forming said wet passages, into said reservoir;

a first airstream that flows into upper side openings of said dry passages and downward through said dry passages; and a second airstream that flows from an area located below said plates and above said reservoir, into open bottom edges of said wet passages and upward through said wet passages before exiting through open top edges of said wet passages, so that said second airstream is directly evaporatively cooled, and thereby indirectly evaporatively cools said first airstream.

2. The evaporative heat exchanger of claim 1, wherein said dry passages are open along said bottom edges and all, or a portion, of said first airstream exiting the bottom of said dry passages becomes all or a portion of said second airstream.

3. The evaporative heat exchanger of claim 2, wherein said dry passages have lower openings along the side edges, and wherein a portion of said first airstream exits through said lower side openings, and the remainder of said first airstream exits at the bottom of said dry passages to become a portion of said second airstream, and wherein the remainder of said second airstream is drawn from a building interior.

4. The evaporative heat exchanger of claim 2, wherein all of said first airstream flowing from the bottom of said dry passages becomes all of said second airstream flowing upward into said wet passages.

5. The evaporative heat exchanger of claim 1, wherein said dry passages are closed along said bottom edges, have openings along lower side edges, and all of said first airstream enters through said dry passage upper side edge openings and exits through lower side edge openings in said dry passages.

6. The evaporative heat exchanger of claim 5, wherein none of said second airstream is drawn directly from the outdoors.

7. The evaporative heat exchanger of claim 6, wherein said first airstream becomes ventilation air for a building after exiting said dry passages, and said second airstream comprises exhaust air from said building.

8. The evaporative heat exchanger of claim 1, wherein said water from said reservoir gains heat by passing through a second heat exchanger before entering said distribution system, and is then evaporatively cooled as it flows downward through said wet passages.

9. The evaporative heat exchanger of claim 1, wherein each of said dry passages is enclosed by opposed parallel plates formed from a single sheet with a 180 degree fold, and said fold is positioned to be the closed top edge of said dry passage.

10. The evaporative heat exchanger of claim 1, wherein the side edges of said plates are formed to close said dry passages except where required to be open for entry and exit of said first airstream, while maintaining a desired spacing between said parallel plate sides.

11. The evaporative heat exchanger of claim 5, wherein the bottom edges of said plate sides are formed to close said dry passage bottom edges.

12. The evaporative heat exchanger of claim 1, wherein said parallel plates include at least one formed projection inboard of said edges to maintain a desired spacing between said parallel plates.

13. The evaporative heat exchanger of claim 12, wherein said parallel plates include interlocking edge projections that hold said plates in parallel position to form a dry passage plate pair.

14. The evaporative heat exchanger of claim 13, wherein said parallel plates include at least one formed projection inboard of said edges to maintain a desired spacing across said wet passages between said dry passage plates.

15. The evaporative heat exchanger of claim 14, wherein said parallel plates include interlocking edge projections that hold adjacent dry passage plate pairs together in parallel position.

16. The evaporative heat exchanger of claim 4, further comprising at least one air mover disposed above said plates to create a negative pressure along the open top edges of said wet passages that causes air to enter said upper side openings of said dry passages and flow downward,exit said dry passages at the open bottom edges and enter said wet passages, andflow upward through the wet passages to exit through said at least one air mover.

17. The evaporative heat exchanger of claim 5, further comprising at least one first air mover that creates a positive pressure along the upper side openings of said dry passagest causing said first airstream to enter said upper side edge openings of said dry passages and flow downward to exit through said dry passage lower side edge openings, and by at least one second air mover located above said plates causing said second airstream to flow into and upward through said wet passages.

18. The evaporative heat exchanger of claim 5, further comprising at least one first air mover that creates a negative pressure along said dry passage lower side openings that causes said first airstream to enter said upper side openings of said dry passages and flow downward to exit through lower side openings, and at least one second air mover located above said plates causing said second airstream to flow into and upward through said wet passages.

19. The evaporative heat exchanger of claim 3, further comprising at least one first air mover that creates a positive pressure along said dry passage upper side openings causing said first airstream to enter said upper side openings of said dry passages and flow downward, with said portion of said first airstream exiting through said lower side edge openings, and by at least one second air mover located above said plates causing said second airstream, including said remainder of said first airstream, to flow into and upward through said wet passages.

20. The evaporative heat exchanger of claim 3, further comprising at least one first air mover that creates a negative pressure along said dry passage lower side edge openings causing said first airstream to enter said upper sideopenings of said dry passages and flow downward, with said portion of said first airstream exiting through said lower side edge openings, and by at least one second air mover located above said plates causing said second airstream, including said remainder of said first airstream, to flow into and upward through said wet passages.

21. The evaporative heat exchanger of claim 19, wherein the at least one air mover operates with variable speed control to maintain equal flow rates for said first and second airstreams.

22. The evaporative heat exchanger of claim 19, wherein at the least one of said air mover operates with variable speed control to maintain a desired fixed flow rate for said first airstream under a range of pressure conditions.

23. The evaporative heat exchanger of claim 19, further comprising at least one first pressure sensor located at said dry passage lower side openings and at least one second pressure sensor located at the bottom edge of said wet passage, and wherein a positive pressure differential between said first and second sensors determines a variable speed of either said first air mover or said second air mover to maintain said positive pressure differential.

24. The evaporative heat exchanger of claim 19, wherein at least one of said air movers operates with variable speed control, and other flow control devices, to maintain desired air flow quantities for said portion of said first airstream and said remainder of said first airstream.

25. The evaporative beat exchanger of claim 1, wherein said parallel plates are formed from a plastic sheet material, the edges of said plates are formed to provide openings and closures for desired air entry and discharge patterns, and the planes of said plates include a pattern of formed projections that maintain desired spacings between the parallel plates.

26. The evaporative heat exchanger of claim 25, wherein said plates comprise plate pairs formed from a single plastic sheet with a 180 degree center fold and wherein said center fold forms a closed top edge to prevent water leaving said distribution system from entering said dry passages.

27. The evaporative heat exchanger of claim 1, wherein said plates further include formed snaps for securing adjacent plates while maintaining a desired parallel plate spacing dimension.

28. The evaporative heat exchanger of claim 1, wherein said plates further include formed turning vanes to smooth and distribute air flow.

29. The evaporative heat exchanger of claim 1, wherein said plates further include formed textured surfaces facing said wet passages.

30. The evaporative heat exchanger of claim 1, wherein said parallel plates are formed from plastic/paper sheet laminates, and said plastic pairs of said laminates face said dry passages, and said paper pairs of said laminates face said wet passages, to cause uniform wetting of the walls of said wet passages and thereby enhance evaporative cooling performance.

31. The evaporative heat exchanger of claim 20, wherein the at least one air mover operates with variable speed control to maintain equal flow rates for said first and second airstreams.

32. The evaporative heat exchanger of claim 20, wherein at the least one of said air mover operates with variable speed control to maintain a desired fixed flow rate for said first airstream under a range of pressure conditions.

33. The evaporative heat exchanger of claim 20, further comprising at least one first pressure sensor located at said dry passage lower side openings and at least one second pressure sensor located at the bottom edge wet passage, and wherein a positive pressure differential between said first and second sensors determines a variable speed of either said first air mover or said second air mover to maintain said positive pressure differential.

34. The evaporative heat exchanger of claim 20, wherein at least one of said air movers operates with variable speed control, and other flow control devices, to maintain desired air flow quantities for said portion of said first airstream and said remainder of said first airstream.

* * * * *